US005447582A

United States Patent [19]

Eylon et al.

[11] Patent Number: 5,447,582

[45] Date of Patent: Sep. 5, 1995

[54] METHOD TO REFINE THE MICROSTRUCTURE OF $\alpha$-2 TITANIUM ALUMINIDE-BASED CAST AND INGOT METALLURGY ARTICLES

[75] Inventors: Daniel Eylon; Leslie S. Apgar, both of Dayton, Ohio

[73] Assignee: The United States of America as represented by the Secretary of the Air Force, Washington, D.C.

[21] Appl. No.: 172,355

[22] Filed: Dec. 23, 1993

[51] Int. Cl.[6] ..... C22C 14/00; C22F 1/00

[52] U.S. Cl. ..... 148/669; 148/421; 420/900

[58] Field of Search ..... 148/669, 421; 420/900

[56] References Cited

U.S. PATENT DOCUMENTS

| | | | |
|---|---|---|---|
| 4,505,764 | 3/1985 | Smickley et al. | 148/669 |
| 4,612,066 | 9/1986 | Levin et al. | 148/669 |
| 4,820,360 | 4/1989 | Eylon et al. | 148/133 |
| 4,872,927 | 10/1989 | Eylon et al. | 148/20.3 |
| 5,032,357 | 7/1991 | Row | 420/421 |
| 5,098,484 | 3/1992 | Eylon et al. | 148/11.5 F |
| 5,108,517 | 4/1992 | Kimura et al. | 148/669 |

*Primary Examiner*—Upendra Roy

*Attorney, Agent, or Firm*—Charles E. Bricker; Thomas L. Kundert

[57] ABSTRACT

The microstructure of alpha-2 and orthorhombic titanium aluminide alloy cast and ingot metallurgy articles is refined by: (a) hydrogenating the article at a temperature at or slightly below the $\beta$-transus temperature of the alloy; (b) cooling the article, under a positive partial pressure of hydrogen, to a temperature about 20 to 40 percent below the $\beta$-transus; and (c) dehydrogenating the article.

7 Claims, 1 Drawing Sheet

METHOD TO REFINE THE MICROSTRUCTURE OF α-2 TITANIUM ALUMINIDE-BASED CAST AND INGOT METALLURGY ARTICLES

RIGHTS OF THE GOVERNMENT

The invention described herein may be manufactured and used by or for the Government of the United States for all governmental purposes without the payment of any royalty.

BACKGROUND OF THE INVENTION

This invention relates to the processing of alpha-2 titanium aluminide alloy articles fabricated by casting or ingot metallurgy to improve the microstructure of such articles.

Titanium alloy parts are ideally suited for advanced aerospace systems because of their excellent general corrosion resistance and their unique high specific strength (strength-to-density ratio) at room temperature and at moderately elevated temperatures. Despite these attractive features, the use of titanium alloys in engines and airframes is often limited by cost due, at least in part, to the difficulty associated with forging and machining titanium.

Recent developments in advanced hypersonic aircraft and propulsion systems require high temperature, low density materials which allow higher strength to weight ratio performance at higher temperatures. As a result, titanium aluminide alloys are now being targeted for many such applications. Titanium aluminide alloys based on the ordered alpha-2 $Ti_3Al$ and orthorhombic $Ti_2AlNb$ phases are currently considered as replacements for the much heavier nickel base alloys such as Inconel 718. These alloys have high specific stiffness, temperature strength and oxidation resistance. However, these alloys lack low temperature ductility, which makes handling, assembly and processing difficult.

Microstructure refinement is one of the most efficient methods to ductilize such alloys. Thermomechanical processing (TMP) methods, such as hot work followed by heat treatment, have been found to be effective in refining the microstructure, thereby increasing the room temperature ductility. Thermomechanical processing is not always an option, especially in net-shape technologies, such as casting or powder metallurgy.

It is widely known that the microstructure of the so-called "ordinary" titanium alloys, i.e., near-alpha, alpha-beta and near-beta alloys, can be refined by temporary alloying with hydrogen. Although hydrogen is beneficial as a transient alloying element for improving the hot workability and superplasticity of titanium and its alloys, pure titanium and many titanium alloys are embrittled at room temperature by the presence therein of only very small quantities of hydrogen.

Eylon et al, U.S. Pat. 4,820,360, issued Apr. 11, 1989, disclose that the fatigue resistance of cast titanium alloys can be increased by temporary alloying with hydrogen. Eylon et al, U.S. Pat. No. 4,872,927, issued Oct. 10, 1989, disclose that the fatigue resistance and superplastic deformation characteristics of wrought titanium alloys can be increased by temporary alloying with hydrogen.

In the area of the ordered titanium alloys, Eylon et al, U.S. Pat. No. 5,098,484, issued Mar. 24, 1992, disclose that the consolidation temperature of prealloyed alpha-2 titanium aluminide powder can be reduced by hydrogenating the powder, filling a die or mold with the powder, consolidating the powder and then dehydrogenating the resulting article.

In the case of cast and ingot metallurgy alpha-2 articles, modification of the microstructure by temporary alloying with hydrogen is severely limited by the relatively low rate of diffusion of hydrogen into the alloy and the limited solubility of hydrogen in the alloy. The optimum temperature for hydrogenation of the alpha-2 titanium aluminide alloys, in terms of maximizing the hydrogen content, varies with the alloy, but is generally about 40% below the beta-transus temperature of the alloy, in degrees C. However, at this temperature the rate of diffusion of hydrogen into the alloy is so slow that hydrogenation time becomes impractically long. The rate of diffusion can be increased by increasing the temperature, but the solubility level decreases with increasing temperature, thereby limiting the amount of hydrogen in solution to such low levels that do not allow microstructure refinement.

Accordingly, it is an object of the present invention to provide an improved process for refining the microstructure of cast and ingot metallurgy alpha-2 and orthorhombic titanium aluminide alloy articles.

Other objects, aspects and advantages of the present invention will be apparent to those skilled in the art after reading the detailed description of the invention as well as the appended claims.

SUMMARY OF THE INVENTION

In accordance with the present invention there is provided a method for refining the microstructure of alpha-2 and orthorhombic titanium aluminide alloy cast and ingot metallurgy articles which comprises the steps of:

(a) hydrogenating an alpha-2 or orthorhombic titanium aluminide alloy cast or ingot metallurgy article at a temperature at or slightly below the β-transus temperature of the alloy;

(b) cooling the article, under a positive partial pressure of hydrogen, to a temperature about 20 to 40 percent below the β-transus; and (c) dehydrogenating the article.

DETAILED DESCRIPTION OF THE INVENTION

Figure 1:
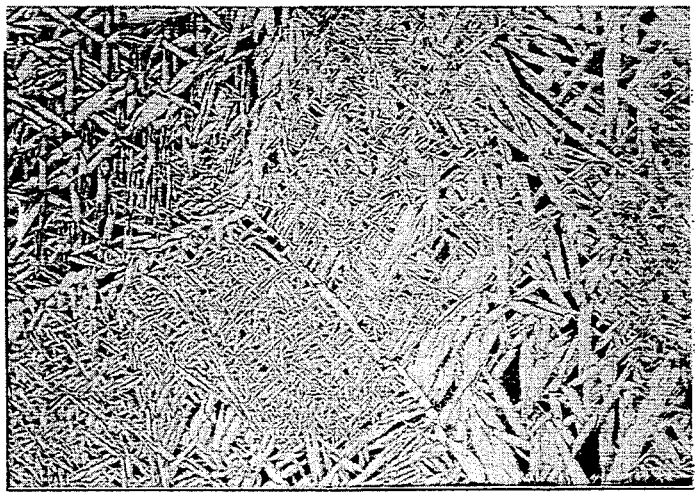
FIG. 1 is a 400× photomicrograph illustrating the microstructure of cast Ti—25Al—10Nb—3V—1Mn alloy following treatment

The titanium-aluminum alloys suitable for use in the present invention are the alpha-2 and orthorhombic alloys containing about 20–30 atomic percent aluminum and about 70–80 atomic percent titanium, and, modified with about 1–25 atomic percent of at least one beta stabilizer selected from the group consisting of Nb, Mo and V. Optionally, the alloy can contain about 0.1–5 atomic percent of at least one other beta stabilizer selected from the group consisting of Mn, Cr, and W. The presently preferred beta stabilizer is Nb. The generally accepted amount of Nb, for optimum balance of high and low temperature properties, is about 10–11 atomic percent. Examples of titanium-aluminum alloys suitable for use in the present invention include Ti—24Al—11Nb and Ti—25Al—10Nb—3Mo—1V.

The cast or ingot metallurgy article is hydrogenated at or slightly below the beta-transus temperature of the alloy. The beta-transus temperature ($T_\beta$) can be determined relatively routinely by standard isothermal heat treatments and metallography, or by Differential Thermal Analysis (DTA), provided the material is homogeneous. The article can be hydrogenated by placing it in a suitable chamber, charging the chamber with a positive pressure of static pure hydrogen or a mixture of hydrogen and in inert gas such as He or At, while heating the chamber to a temperature at or near the beta-transus temperature for a suitable time. At this temperature, the diffusivity of hydrogen in the alloy is high, but the solubility is low.

The article is next cooled to about 20 to 40 percent below the beta-transus temperature (in degrees C), under a positive partial pressure of hydrogen. At this temperature, the solubility of hydrogen in the alloy is high, but the diffusivity is low.

Finally, the article is dehydrogenated. Dehydrogenation may be accomplished by heating the article at a temperature well below the beta-transus temperature, e.g., about 1200°–1400° F. (650°–760° C.), under vacuum for about 12 to 48 hours.

Hydrogenation of the article can be carried out by heating the article under a positive partial pressure of hydrogen at about the beta-transus temperature for about 8 to 12 hours, lowering the temperature, while still under a positive partial pressure of hydrogen, to about 20 to 40 percent below the beta-transus temperature and holding for about 8 to 12 hours, then dehydrogenating the article. For example, an article fabricated from the alloy Ti—25Al—10Nb—3V—1Mn when heated to 1800° F. (980° C.) under hydrogen and held for 10 hours, then cooled to 1200° F. (650° C.), under hydrogen, and held for 10 hours, resulted in about 0.4 weight percent hydrogen in solution in the alloy.

Alternatively, the heating and cooling steps can be carried out in stepwise fashion. For example, an article fabricated from the alloy Ti—25Al—10Nb—3V—1Mn when heated to 1800° F. (980° C.) under hydrogen for 2 hours, cooled to 1600° F. (870° C.) and held 4 hours, cooled to 1400° F. (760° C.) and held 6 hours, cooled to 1200° F. (650° C.) and held 6 hours, all under hydrogen, a resulted in about 0.4 weight percent hydrogen in solution in the alloy.

The following examples illustrate the invention:

EXAMPLES

Cast samples of the alloy Ti—25Al—10Nb—3V—1Mn were machined into 0.25 in.×0.25 in.×1.75 in. rectangular pins for testing. Hydrogenation was done in a pure hydrogen environment under a partial pressure of 3 psi inside a 304 stainless steel vacuum tube furnace.

The first sample pin was heated to 1800° F. (980° C.) under hydrogen for 2 hours, cooled to 1600° F. (870° C.) and held 4 hours, cooled to 1400° F. (760° C.) and held 6 hours, cooled to 1200° F. (650° C.) and held 6 hours, all under a positive hydrogen pressure. The resulting sample contained about 0.4 weight percent hydrogen in solution in the alloy. The sample was dehydrogenated under vacuum at a temperature of about 1200° F. for 48 hours.

Figure 2:
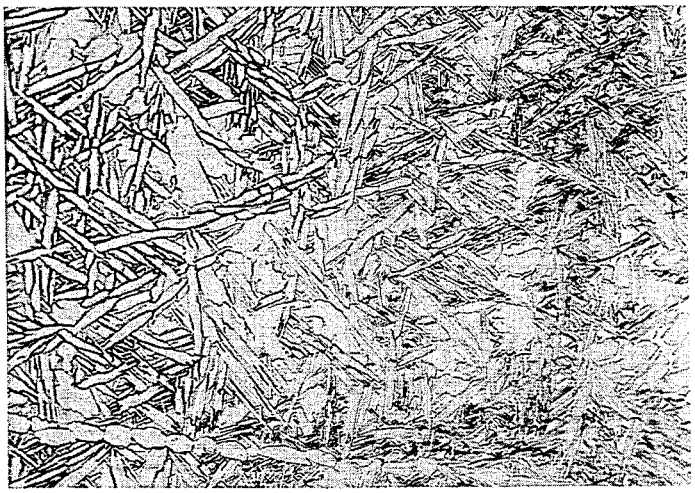
FIG. 2 is a 400× photomicrograph illustrating the microstructure of cast Ti—25 Al—10Nb—3V—1Mn alloy subjected to the same thermal cycles as the sample shown in FIG. 1, but without hydrogen.

A second sample was subjected to the same heating cycle as above, but without hydrogen. FIG. 2 illustrates the resulting microstructure, which is typified by coarse alpha-two plates. This microstructure is similar to the microstructure of the as-cast material. In contrast, the microstructure of the hydrogenated sample (FIG. 1) clearly shows significant change in the microstructure which is typified by coarse alpha-two plates plus finer alpha-two plates.

Figure 3:
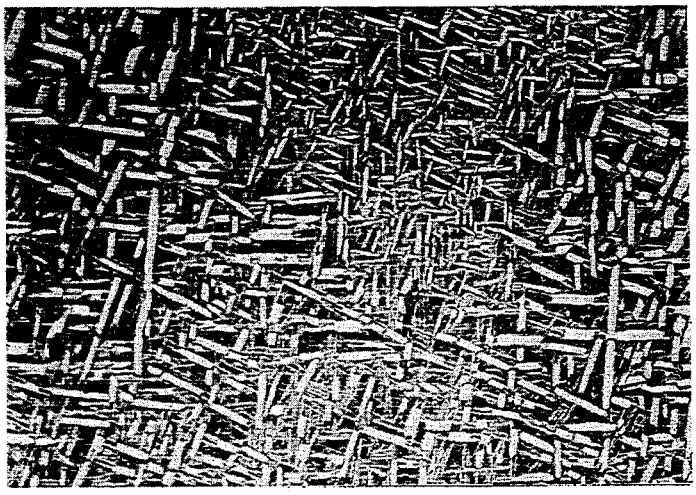
FIG. 3 is a 400× photomicrograph illustrating the microstructure of cast Ti—25Al—10Nb—3V—1Mn alloy following a different treatment in accordance with the invention.

A third sample was heated to 1800° F. (980° C.) under hydrogen for 10 hours, cooled to 1200° F. (650° C.) and held 10 hours, all under a positive hydrogen pressure. The resulting sample contained about 0.4 weight percent hydrogen in solution in the alloy. The sample was dehydrogenated under vacuum at a temperature of about 1200° F. for 48 hours. The microstructure of this sample (FIG. 3) is also typified by coarse alpha-two plates plus finer alpha-two plates.

Various modifications may be made to the invention as described without departing from the spirit of the invention or the scope of the appended claims.

We claim:

1. A method for refining the microstructure of titanium aluminide alloy cast and ingot metallurgy articles which comprises the steps of:

(a) hydrogenating said titanium aluminide alloy cast or ingot metallurgy article at a temperature at or slightly below the $\beta$-transus temperature of the alloy;

(b) cooling the article, under a positive partial pressure of hydrogen, to a temperature about 20 to 40 percent below the $\beta$-transus; and (c) dehydrogenating the article;

wherein said alloy contains about 20–30 atomic percent aluminum, about 70–80 atomic percent titanium, and about 1–25 atomic percent of at least one beta stabilizer selected from the group consisting of Nb, Mo and V;

and wherein the time period of steps (a) and (b) is about 16 to 24 hours.

2. The method of claim 1 wherein said alloy further contains about 0.1–5 atomic percent of at least one other beta stabilizer selected from the group consisting of Mn, Cr, and W.

3. The method of claim 1 wherein said alloy is Ti—24Al—11Nb.

4. The method of claim 1 wherein said dehydrogenation step (c) comprises heating said article at about 650° to 760° C., under vacuum, for about 12 to 48 hours.

5. The method of claim 2 wherein said alloy is Ti—25Al—10Nb—3V—1Mn.

6. The method of claim 5 wherein said article is held at or near said $\beta$-transus temperature for about 8 to 12 hours, then cooled to about 20 to 40 percent below the $\beta$-transus and held for about 8 to 12 hours, then dehydrogenated.

7. The method of claim 5 wherein said article is held at or near said $\beta$-transus temperature for about 2 hours, cooled to about 10 percent below said $\beta$-transus temperature and held for about 4 hours, cooled to about 25 percent below said $\beta$-transus temperature and held for about 6 hours, cooled to about 35 percent below said $\beta$-transus temperature and held for about 6 hours, then dehydrogenated.

* * * * *